US005664342A

United States Patent [19]

Buchsenschuss

[11] Patent Number: 5,664,342

[45] Date of Patent: Sep. 9, 1997

[54] INSOLE WITH FLEXIBLE MASSAGING KNOBS

[75] Inventor: Meta Buchsenschuss, Kaiserslautern, Germany

[73] Assignee: Prodomo S.A., Luxembourg, Luxembourg

[21] Appl. No.: 671,084

[22] Filed: Jun. 27, 1996

Related U.S. Application Data

[63] Continuation of Ser. No. 332,653, Nov. 1, 1994, abandoned, which is a continuation of Ser. No. 25,513, Mar. 2, 1993, abandoned.

[30] Foreign Application Priority Data

Mar. 4, 1992 [DE] Germany ..... 42 06 818.5

[51] Int. Cl.[6] ..... A61F 5/14; A43B 13/38

[52] U.S. Cl. ..... 36/43; 36/141

[58] Field of Search ..... 36/43, 44, 141, 36/11.5, 140

[56] References Cited

U.S. PATENT DOCUMENTS

| | | | |
|---|---|---|---|
| D. 294,076 | 2/1988 | Birrittella | 36/11.5 X |
| 4,047,310 | 9/1977 | Sunoo | 36/11.5 |
| 4,079,526 | 3/1978 | Fukuoka | 36/44 X |
| 4,509,510 | 4/1985 | Hook | 36/44 X |
| 4,694,590 | 9/1987 | Greenawalt | 36/91 |
| 4,694,831 | 9/1987 | Seltzer | 36/43 X |
| 4,727,661 | 3/1988 | Kuhn | 36/43 X |
| 4,760,655 | 8/1988 | Mauch | 36/43 X |
| 4,841,647 | 6/1989 | Turucz | 36/43 X |
| 4,841,648 | 6/1989 | Shaffer et al. | 36/43 |
| 5,154,682 | 10/1992 | Kellerman | 36/44 |
| 5,322,056 | 6/1994 | Menghi | 36/11.5 X |

FOREIGN PATENT DOCUMENTS

| | | | |
|---|---|---|---|
| 0193805 | 9/1986 | European Pat. Off. . | |
| 0225285 | 6/1987 | European Pat. Off. . | |
| 0279933 | 8/1988 | European Pat. Off. | 36/11.5 |
| 3520956 | 1/1987 | Germany . | |
| WO8702551 | 5/1987 | WIPO . | |

*Primary Examiner*—B. Dayoan

*Attorney, Agent, or Firm*—Weingarten, Schurgin, Gagnebin & Hayes LLP

[57] ABSTRACT

The object of this invention is an insole having profiles on its upper surface, for enabling a massaging effect on the tissue of a foot. According to the invention the profiles, formed in the shape of knobs (2*a*), are arranged in special areas (2) of the sole area, these special areas being selected in accordance with aspects of reflex zone therapy in order to activate certain organs.

10 Claims, 3 Drawing Sheets

INSOLE WITH FLEXIBLE MASSAGING KNOBS

This application is a continuation of application Ser. No. 08/332,653 filed Nov. 1, 1984, now abandoned, which application is a continuation of application Ser. No. 08/025,513 filed Mar. 2, 1993, now abandoned.

FIELD OF THE INVENTION

The present invention relates to an insole for shoes, which has profiles on its upper surface.

BACKGROUND OF THE INVENTION

Various insoles for improving the fit of a shoe slightly too large, for keeping feet warm and/or for supporting the plantar arch have been known for a long time. In addition, there are single layer and multilayer insoles, especially those made of cork, which have continuous profiles in the form of ridges and grooves on their upper surface. The shape of these insoles is adapted to a sole area of an inner surface of a shoe sole, so that the entire sole area of the shoe is covered by such an insole. Displacement of the insole, which is lying loosely on the inner surface of the shoe sole, is prevented by uppers adjacent to and in contact with the insole. Profiles extending over the entire upper surface of the insole have a massaging effect on a walking person's sole, so as to activate the blood circulation in the foot. It is not possible to achieve any further therapeutic effect by using these insoles.

SUMMARY OF THE INVENTION

The term "reflex zone therapy" describes a treatment based on the established fact that special zones of the soles and palms are correlated to certain internal organs. A therapist can diagnose certain diseases of these organs by applying pressure on the corresponding reflex zones of the sole, which will cause the patient a more or less intensive sensation of pain. On the other hand, the therapist can achieve an intensive stimulation of the corresponding organ by carefully massaging these special zones.

It is an object of this invention to provide an insole which has a therapeutic effect beyond stimulating the blood circulation in the foot tissue and makes it possible to influence purposefully the functions of certain internal organs.

According to this invention this object is achieved by arranging the profiles, which are formed on the upper surface of the insole in the shape of knobs, in special areas of the sole area, which are selected in accordance with aspects of reflex zone therapy in order to activate certain internal organs.

The purposeful arrangement of the knobs within predetermined zones of the insole has the effect the certain zones of the soles of a wearer are automatically being massaged while he is walking, and this effect in turn influences the organs corresponding to these zones. It is essential that the selection of the shape, the density and the consistency of the knobs be such that a sufficiently effective massage of these sole zones is achieved and any sensation of pain is avoided. The effect of this massage is an activation of the organs corresponding to the sole zones. The insoles according to the present invention are particularly suitable for overweight persons if the knobs are arranged on the upper surface of the sole within the zones corresponding to the liver, the stomach, the bladder, the small and large intestine, and the kidneys, as the activation of these organs intensifies their action and thus promotes all metabolic processes including excretion. Mass examinations have revealed that a person wearing these insoles temporarily can achieve a steady loss of weight without suffering any impairment of his well-being.

In a convenient arrangement of this invention the knobs should be about 0.3 to 3.0 mm in height and 1.0 to 4.0 mm in diameter and be made of a rubber-elastic material. Conveniently, the insole should be made up of several layers, the knobs being borne by a lower rubber-elastic layer with which they are integrally formed, and an upper layer made of leather, textile, cork, or the like, being attached to the areas not covered by knobs to improve the conditions the feet are exposed to, even when shoes are worn for a long time.

Conveniently, the insole does not extend over the entire surface of the sole, but just from a heel to a ball area, a tapered front edge of the upper leather layer extending over the front edge of the rubber-elastic lower layer. This size and shape of the insole has the advantage that an entire range of shoes (ladies' shoes and gentlemen's shoes) can be covered with just four sizes, as the areas of the plantar arch and the heel do not vary to the same extent as the areas of the heel and the ball of the foot do. Conveniently, the lower surface of the insole is provided with adhesion means in the form of, for example, strips adhesive on both sides, which make it possible to removably fasten the insole on the inner surface of the shoe sole to prevent displacement of these insoles, which extend over about three quarters of the sole area.

Further features and advantages have been realized in the examples of embodiment shown in the drawings, which examples will now be described in detail.

DETAILED DESCRIPTION

Figure 1:
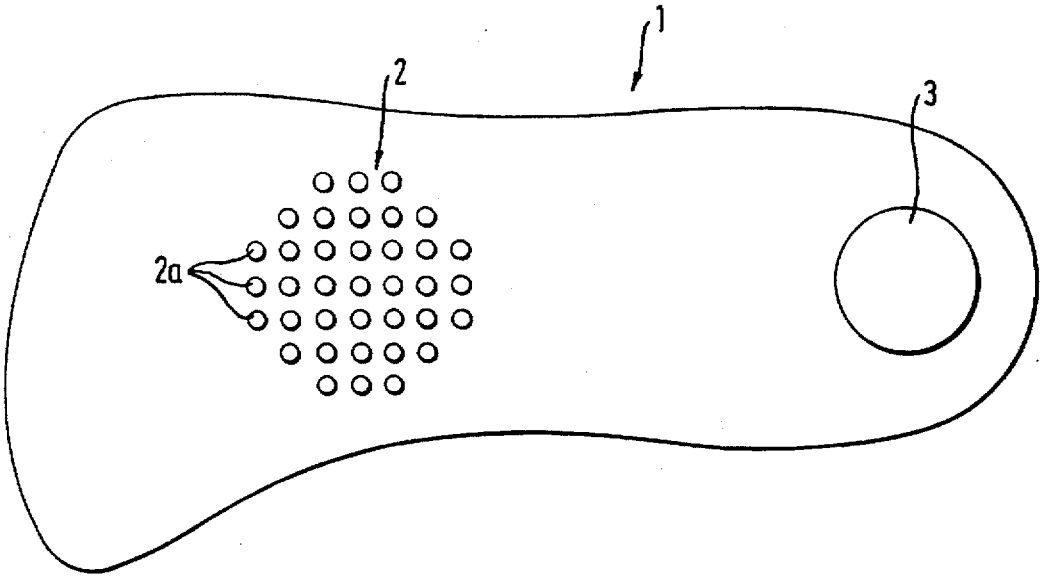
FIG. 1 is a schematic top view showing an insole, according to the invention.

The insole 1 has an outline adapted to a heel area and a metatarsus and is preferably made of a flexible material such as rubber or flexible plastics several millimeters thick.

In order that a single insole size may be suitable for several shoe sizes, the insole 1 shown in the drawings extends over three quarters of the sole area only, leaving a toe area exposed. Such a shape has the advantage that only four insole sizes are required for covering all shoe sizes.

Figure 3:
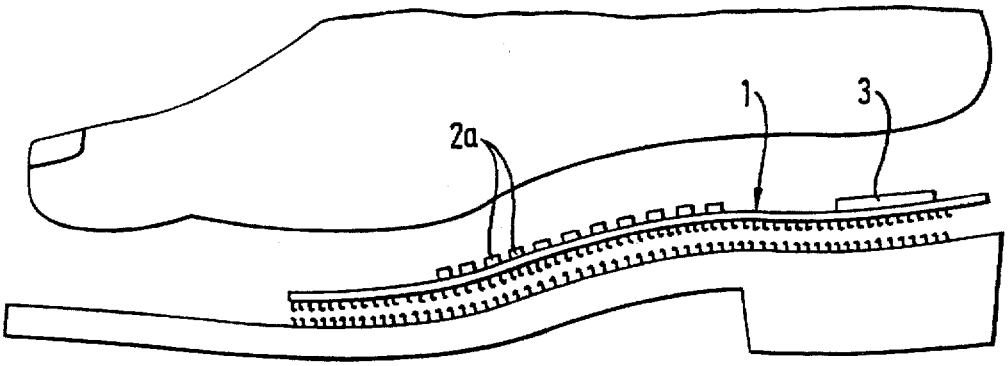
FIG. 3 is a side view of an embodiment of an insole in accordance with the invention.

The insole has knobs 2*a* in selected areas 2 of its upper surface, the knobs 2*a* being distributed over parts of the sole area such that they are arranged in certain patterns. The knobs are preferably made of the flexible material used for the insole 1 and integrally formed with the insole 1. Alternatively, the knobs 2*a* may be made of a different material such as a cork-latex composite and be firmly fixed to the insole made of a material such as leather, dimensionally stable plastics, etc. In order to achieve an adequate massaging effect without straining the plantar zones excessively, the knobs 2*a* are preferred to be 0.3 to 3.0 mm high and about 1.0 to 4.0 mm in diameter, the space between two adjacent knobs being about the same size as their diameters. In a simple embodiment, as shown in FIGS. 1 and 3, a substantially circular pad 3 is formed in the central heel area to reduce the impact when the foot is put down, the pad 3 being made of the flexible sole material or some kind of foam rubber.

Figure 2:
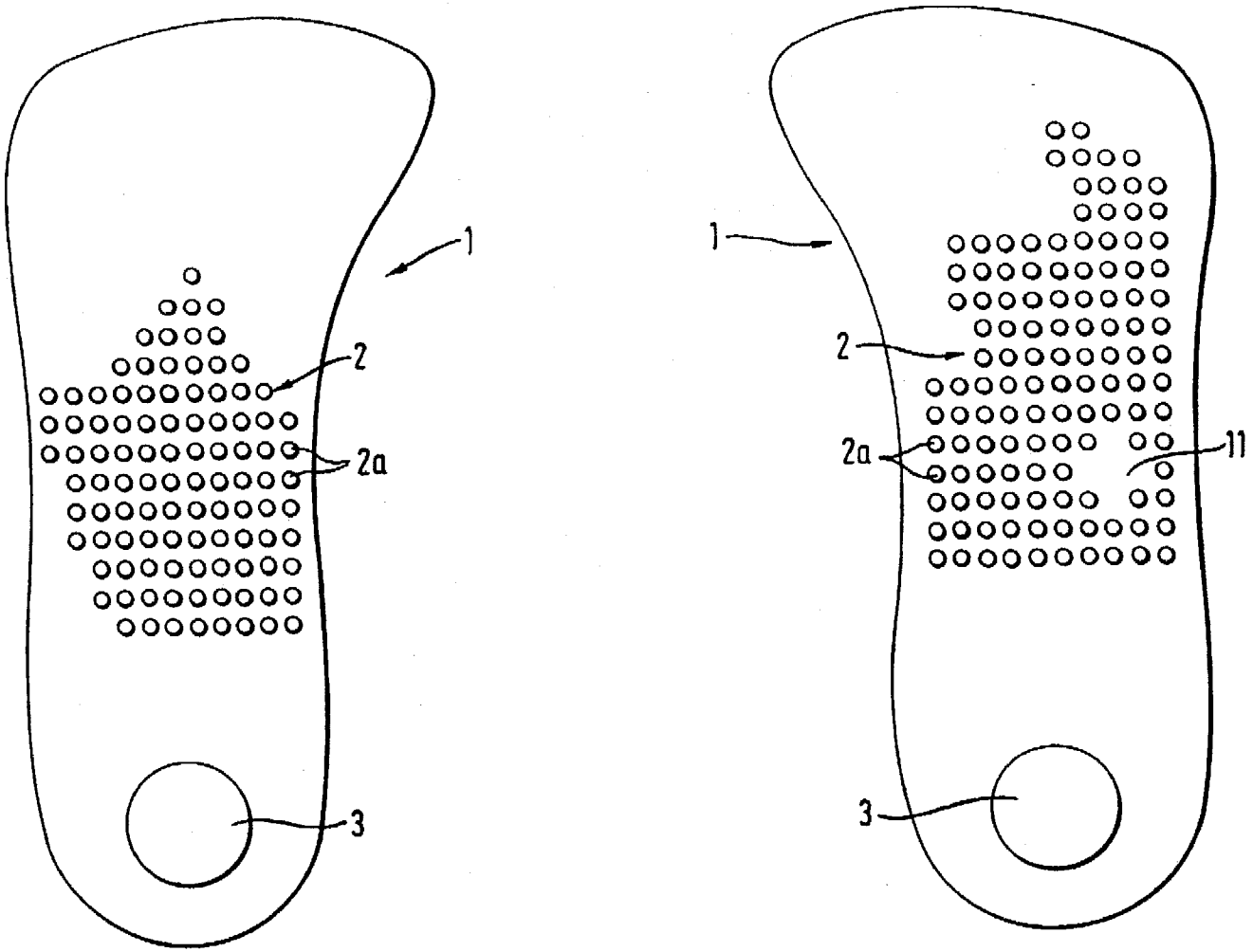
FIG. 2 is a view of right and left insoles according to the invention with knobs arranged in different zones.

As can be seen from FIGS. 2 and 4 in particular, the knobs 2*a* are distributed over an upper surface of the sole such that they are arranged in certain zones 2 in accordance with the findings of the reflex zone therapy. As is known, reflex zone therapy starts out from the fact that bodily functions and organs can be stimulated or influenced by massaging certain plantar zones or sites. These reflex zones include solar plexus, diaphragm, pituitary gland, brain, thyroid, parathyroid gland, sinus, ear, eye, lung, heart, stomach, spleen, pancreas, liver, gallbladder, adrenal gland, kidney, bladder, ureter, urethra, intestine, arm, shoulder, spine, hip, thigh, leg, sciatic nerve, ovary, testicle, lymphatic system, breast, uterus, and prostate reflex zones.

The arrangement according to the present invention of the knobs within selected zones 2 on the upper surface of the insoles automatically effects a massage of the plantar zones when the wearer is walking, so as to intensity blood circulation in the tissue of the foot as well as stimulate the organs corresponding to these plantar zones. Since the particular zones for the respective organs are not distributed symmetrically on the soles of the feet, the corresponding distribution of the knob-bearing zones 2 of the insoles is also asymmetric, as shown in the pair of left and right insoles of FIG. 2. The soles of this embodiment have been conceived for treating obesity automatically, the knobs being arranged only in the areas opposite the plantar zones for activating the liver, the stomach, the intestinal tract, the kidneys and the bladder in accordance with the reflex zone therapy.

Figure 4A:
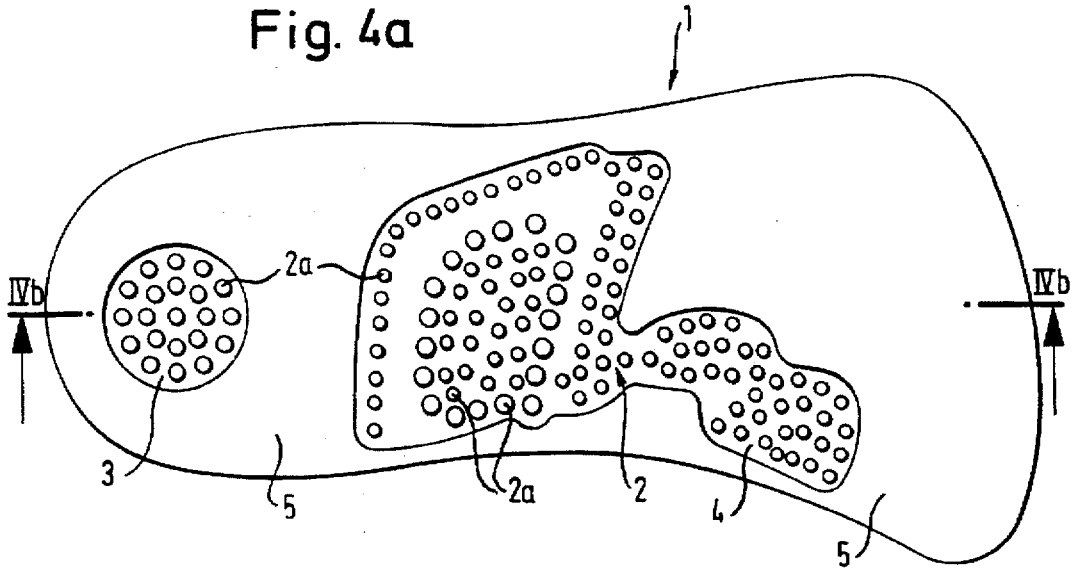
FIGS. 4*a* to 4*c* are a top view, a longitudinal section and a bottom view, each showing an insole conceived for reducing a wearer's weight.
Figure 4B:
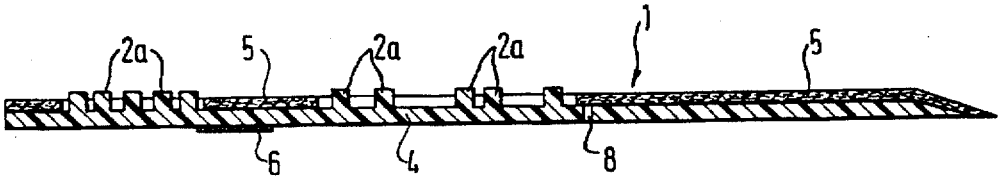
Figure 4C:
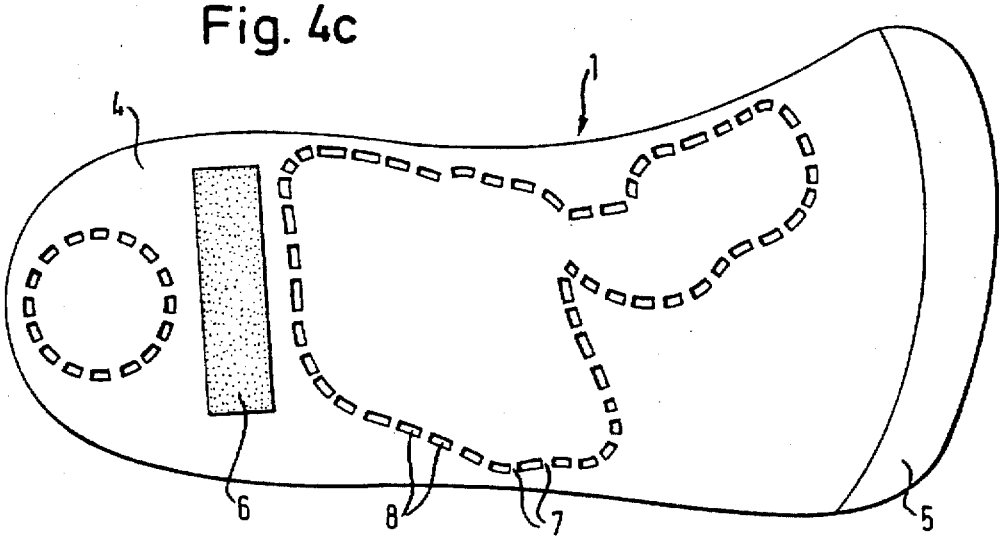

In the embodiment according to FIGS. 4*a* to 4*c* the insole 1 comprises a lower flexible rubber layer 4, with the knobs 2*a* being integrally formed with this rubber layer 4 on its upper surface. A top layer 5 made of leather or other fine-pored material is glued or vulcanized on the upper surface of this rubber layer 4, the top layer 5 covering only the area of the rubber layer 4 in which there are no knobs 2*a*. Conveniently, the knobs 2*a* rise several millimeters above this leather top layer 5. At least one strip 6, adhesive on both sides, is removably fixed to the lower surface of the rubber layer 4, for fastening the insole on the upper surface of the shoe sole, so that it does not slip. In this embodiment an additional zone provided with knobs 2*a* is formed in the circular heel area 3, this zone being surrounded by a circular cut-out in the top layer 5. As can be seen in FIGS. 4*a* and 4*c*, the knob-bearing area in the central part of the insole is surrounded by the leather top layer 5 cut out in this area, a slit 8 in the rubber layer, which is interrupted by a plurality of crosspieces 7, following the outline of this cut-out in the top layer, according to FIG. 4*c*. The embodiment shown in FIG. 4 is a left insole, the matching right insole being provided with knobs 2*a* in different zones, as in the embodiment according to FIG. 2, since the reflex zones for certain organs are not symmetrically distributed on the soles of the feet.

The invention is not limited to the examples of embodiments shown in the drawings and described above. Thus, the knobs may have other shapes and dimensions, for example. Furthermore, the insole may have a dimensionally stable lower part, such as the one used for orthopedic purposes. Finally, for special therapeutical measures, it is also possible to extend the insole described above to the tip of the toe and arrange knobs in certain zones of this front area, so as to bring about a massaging effect on the toes.

I claim:

1. A slenderizing insole system, comprising:

a flexible slenderizing left insole including a first rubber layer having a first surface and a second surface, a first plurality of flexible knobs located on said first surface of said first rubber layer, wherein said first plurality of flexible knobs is disposed in a first plurality of reflex zones associated with a body organ to be stimulated, a second plurality of flexible knobs located on said first surface of said rubber layer, and a first leather top layer disposed on said first surface of said first rubber layer, said first leather top layer having a first opening through which said first plurality of flexible knobs protrudes and a second opening through which said second plurality of flexible knobs protrudes; and a flexible slenderizing right insole including a second rubber layer having a first surface and a second surface, a third plurality of flexible knobs disposed on said first surface of said second rubber layer, wherein said third plurality of flexible knobs is disposed in a second plurality of reflex zones associated with a body organ to be stimulated, a fourth plurality of flexible knobs located on said first surface of said second rubber layer, and a second leather top layer disposed on said first surface of said second rubber layer, said second leather top layer having a third opening through which said third plurality of flexible knobs protrudes and a fourth opening through which said fourth plurality of flexible knobs protrudes.

2. The insole system of claim 1, wherein said knobs are 0.3 to 3.0 millimeters high and 1.0 to 4.0 millimeters in diameter.

3. The insole of claim 1, wherein each said insole includes a heel portion that defines a first longitudinal end of said insole and a ball portion that defines a second longitudinal end of said insole.

4. The insole system of claim 1 further comprising a first adhesion element located on said second surface of said first rubber layer of said flexible slenderizing left insole and a second adhesion element located on said second surface of said second rubber layer of said flexible slenderizing right insole.

5. The insole system of claim 1, further comprising a first raised heel on the first surface of said first rubber layer of said flexible slenderizing left insole and a second raised heel on the first surface of said second rubber layer of said flexible slenderizing right insole.

6. A slenderizing insole system, comprising:

a flexible slenderizing left insole including a first rubber layer having a first surface and a second surface, a first plurality of flexible knobs located on said first surface of said first rubber layer, wherein said first plurality of flexible knobs is disposed in a first plurality of reflex zones associated with digestive organ stimulation, a second plurality of flexible knobs located on said first surface of said rubber layer, and a first leather top layer disposed on said first surface of said first rubber layer, said first leather top layer having a first opening through which said first plurality of flexible knobs protrudes and a second opening through which said second plurality of flexible knobs protrudes; and a flexible slenderizing right insole including a second rubber layer having a first surface and a second surface, a third plurality of flexible knobs disposed on said first surface of said second rubber layer, wherein said third plurality of flexible knobs is disposed in a second plurality of reflex zones associated with digestive organ stimulation, a fourth plurality of flexible knobs located on said first surface of said second rubber layer, and a second leather top layer disposed on said first surface of said second rubber layer, said second leather top layer having a third opening through which said third plurality of flexible knobs protrudes and a fourth opening through which said fourth plurality of flexible knobs protrudes.

7. The insole system of claim 6, wherein said knobs are 0.3 to 3.0 millimeters high and 1.0 to 4.0 millimeters in diameter.

8. The insole of claim 6, wherein each said insole includes a heel portion that defines a first longitudinal end of said insole and a ball portion that defines a second longitudinal end of said insole.

9. The insole system of claim 6, further comprising a first adhesion element located on said second surface of said first rubber layer of said flexible slenderizing left insole and a second adhesion element located on said second surface of said second rubber layer of said flexible slenderizing right insole.

10. The insole system of claim 6, further comprising a first surface of said first rubber layer of said flexible slenderizing left insole and a second raised heel on the first surface of said second rubber layer of said flexible slenderizing right insole.

* * * * *